US012270130B2

(12) United States Patent
Schweizer

(10) Patent No.: US 12,270,130 B2
(45) Date of Patent: Apr. 8, 2025

(54) BIODEGRADABLE YARN WITH AN INCREASED FLAME RESISTANCE AND MANUFACTURING METHOD THEREOF

(71) Applicant: OceanSafe AG, Bern (CH)

(72) Inventor: Manuel Schweizer, Ittigen (CH)

(73) Assignee: OceanSafe AG (CH)

( * ) Notice: Subject to any disclaimer, the term of this patent is extended or adjusted under 35 U.S.C. 154(b) by 0 days.

(21) Appl. No.: 18/036,196

(22) PCT Filed: Nov. 10, 2020

(86) PCT No.: PCT/EP2020/081639
§ 371 (c)(1),
(2) Date: May 10, 2023

(87) PCT Pub. No.: WO2022/100818
PCT Pub. Date: May 19, 2022

(65) Prior Publication Data
US 2023/0416954 A1 Dec. 28, 2023

(51) Int. Cl.
*D02G 3/44* (2006.01)

(52) U.S. Cl.
CPC ..... *D02G 3/443* (2013.01); *D10B 2201/24* (2013.01); *D10B 2331/04* (2013.01); *D10B 2401/12* (2013.01)

(58) Field of Classification Search
CPC ..... D02G 3/443; D10B 2401/12; D10B 2201/24; A10B 2331/04
See application file for complete search history.

(56) References Cited

U.S. PATENT DOCUMENTS 2,313,104 A * 3/1943 Wallach ..... D02G 3/402 57/297
4,439,487 A * 3/1984 Jennings ..... D01F 8/12 428/397
5,069,970 A * 12/1991 Largman ..... D01F 6/92 428/397
5,313,776 A * 5/1994 Humbrecht ..... D02G 1/0286 57/247
7,365,033 B1 * 4/2008 Murphy ..... A47C 31/001 428/920
9,677,206 B2 * 6/2017 Lee ..... D03D 27/02
2002/0045395 A1 * 4/2002 Lintecum ..... D02G 1/18 438/364
2009/0203281 A1 * 8/2009 He ..... D01D 5/0985 525/384
2009/0291607 A1 * 11/2009 Wang ..... D04H 3/16 525/437
2013/0309932 A1 * 11/2013 He ..... D01F 8/14 525/437
2013/0344764 A1 * 12/2013 He ..... D04H 3/14 528/295.3
2014/0083438 A1 * 3/2014 Sebastian ..... A24B 13/00 131/290
2015/0272836 A1 * 10/2015 Bonner ..... A61K 8/06 15/104.93
2015/0328928 A1 * 11/2015 Justine ..... D02G 3/48 152/451
2016/0047069 A1 * 2/2016 Justine ..... D02G 3/047 57/238
2018/0016885 A1 * 1/2018 Collins ..... C09K 8/70
2019/0376017 A1 * 12/2019 Eryilmaz ..... D06M 23/02
2020/0297554 A1 * 9/2020 Petersen ..... D04H 1/4258
2021/0348356 A1 * 11/2021 Wendeler-Goeggelmann ..... E02B 3/126
2023/0363613 A1 * 11/2023 Truong ..... A47L 13/34
2024/0043805 A1 * 2/2024 Halberstadt .... C12Y 207/07049
2024/0115981 A1 * 4/2024 Abderrahmen ..... B01D 39/18
2024/0117539 A1 * 4/2024 Gentilcore ..... D04H 1/4258
2024/0125252 A1 * 4/2024 Breaux ..... F03G 6/065

FOREIGN PATENT DOCUMENTS

CN 107805870 A 3/2018
WO WO2014173055 A1 10/2014

OTHER PUBLICATIONS

CN107805810 Machine Language Translation.
International Search Report for PCT/EP2020/081639, dated Jul. 19, 2021, prepared by the European Patent Office (in English).
WO2014173055A1 Machine Language Translation.

* cited by examiner

*Primary Examiner* — Bao-Thieu L Nguyen
(74) *Attorney, Agent, or Firm* — Lerner David LLP

(57) ABSTRACT

This application relates to a biodegradable yarn which exhibits an increased flame resistance. The biodegradable yarn comprises from 25 to 55 weight-%, preferably from 35 to 45 weight-% of viscose fibers or of viscose filaments and from 45 to 65 weight-%, preferably from 50 to 60 weight-%, most preferably 55 weight-% of polybutylene succinate fibers. The viscose fibers or filaments are preferably free of chlorine. Further, the present application concerns a method for manufacturing a biodegradable yarn having an increased flame resistance.

19 Claims, No Drawings

BIODEGRADABLE YARN WITH AN INCREASED FLAME RESISTANCE AND MANUFACTURING METHOD THEREOF

CROSS REFERENCE TO RELATED APPLICATIONS

This application is a national phase application of International Application No. PCT/EP2020/081639, filed on Nov. 10, 2020, the content of which is incorporated herein by reference.

BACKGROUND OF THE INVENTION

Field of the Invention

The invention relates to a biodegradable yarn with an increased flame resistance. Further, the present invention also relates to a method for manufacturing a biodegradable yarn with an increased flame resistance.

Description of Related Art

Today approximately 110 million tons of yarn are produced annually. The production is expected to increase to almost 130 million tons per year by 2025. While the production of cotton and wool yarn remained stable in the last 40 years, the amount of yarn made of synthetic material fibres, especially of polyester fibres has greatly increased in the same time from approximately 10 million tons per year in 1980 to almost 80 million tons per year in 2020. As yarn made of synthetic fibres is not biodegradable, discarded textiles made of such yarn constitute an ever-increasing ecological problem.

Hence, in recent years, the interest in biodegradable yarn has increased. While there are many biodegradable yarns available today, one major problem remains for applications where an increased flame resistance is needed, as production of flame resistant yarn relies on the treatment of the fibres or of the yarn with flame retardants which are not biodegradable, as they usually rely on inorganic compounds (such as e.g. metal oxides), organohalogen compounds (e.g. comprising bromine) or organophosphorus compounds.

Further, other solutions to increase the flame resistance of yarn are known, such as e.g. disclosed in CN 107805870 to Zhejiang Dunnu United Ind. Co. Ltd. This document discloses a core yarn with a core of viscose fibres which is wrapped by fibres of a polyester. However, the yarn disclosed by this document is not biodegradable.

Hence, as of today, no biodegradable yarn with an increased flame resistance is known in the art.

BRIEF SUMMARY OF THE INVENTION

It is the object of the invention to create a biodegradable yarn which exhibits an increased flame resistance.

The solution of the invention is specified by the features of claim 1. According to the invention the biodegradable yarn comprises from 25 to 55 weight-%, preferably from 35 to 45 weight-% of viscose fibres or of viscose filaments and from 45 to 65 weight-%, preferably from 50 to 60 weight-%, most preferably 55 weight-% of polybutylene succinate fibres. The viscose fibres or filaments are preferably free of chlorine.

The combination of viscose and polybutylene succinate yields a yarn which has an increased flame resistance and which fulfils the criteria for the class B1 according to the norm DIN 4102-1 and EN 13501-1.

Both viscose and polybutylene succinate are completely biodegradable, such that the yarn itself may also be completely biodegraded. By using a chlorine free viscose the impact of the yarn on the environment can further be considerably reduced. The yarn further exhibits a breaking load of 6 N and a maximal elongation of approximately 13%.

Preferably, the viscose and/or the polybutylene succinate used for the biodegradable yarn are certified under the Cradle to Cradle™ products program.

Preferably, the yarn further comprises from 5 to 15 weight-%, preferably 10 weight-% of fibres of a co-polyester, preferably of a co-polyester which is free of antimony. The co-polyester preferably is biodegradable.

Preferably, the yarn comprises viscose filaments which act as core of the yarn. The fibres of polybutylene succinate and—if present—the fibres of co-polyester are wrapped around said core. Preferably, the yarn comprises multiple viscose filaments which act as core. The multiple viscose filaments may be twisted together or alternatively arranged next to one another to form the core. If the yarn comprises fibres of co-polyester, then said fibres are mixed with the fibres of polybutylene succinate. The fibres of polybutylene succinate and—if present—the fibres of co-polyester are provided as staple fibres which are spun around the core.

In an alternatively preferred embodiment, the yarn comprises viscose fibres. Both the viscose fibres and the polybutylene succinate fibres are provided as staple fibres so that the yarn is a staple fibre yarn. In this case, preferably the yarn does not comprise a co-polyester.

Preferably the viscose fibres and/or the polybutylene succinate fibres have an average length of from 25 to 45 mm, preferably from 30 to 40 mm, most preferably of 38 mm.

Use of fibres with an average length, which is also known as staple length, yields a yarn which is suitable for diverse textile applications, such as the production of fabrics for furniture, garments, curtains, tapestry and even work-wear. Textiles produced with the inventive yarn may exhibit an abrasive resistance of up to 80'000 Martindale as well as being highly crease-resistant.

Preferably, the yarn has a twist per meter of at least 400, preferably of at least 600. It was found that provision of such a twist increases the flame resistance of the yarn, such that the criteria for the class B1 according to the norm DIN 4102-1 and EN 13501-1 may even be surpassed.

Preferably, the polybutylene succinate is of organic origin. This means that the precursors of the polybutylene succinate, namely 1,4-butanediol and succinic acid have been obtained from glucose and not from crude oil through petrochemical methods.

The yarn preferably has a linear density of at least 13 gram per 1000 m (130 dtex), more preferably of at least 16 gram per 1000 m (160 dtex).

Preferably, the yarn further comprises at least one dye. The at least one dye preferably is a reactive dye which is biodegradable.

The present invention further relates to a method for manufacturing a biodegradable yarn with an increased flame resistance, especially a biodegradable yarn as disclosed above.

In the inventive method from 25 to 55 weight-%, preferably from 35 to 45 weight-% of staple fibres or filaments of viscose and from 45 to 65 weight-%, preferably from 50 to 60 weight-%, most preferably 55 weight-% of staple fibres of polybutylene succinate are spun to the yarn.

Both viscose and polybutylene succinate are biodegradable, such that the yarn obtained by the inventive method is entirely biodegradable, too.

The yarn preferably is spun by ring spinning. Alternatively, the yarn may be spun by means of compact spinning, of rotor spinning or air-jet spinning.

Filaments of polybutylene succinate are preferably mechanically stretched to an elongation of at least 300% prior to being ripped to form the staple fibres of polybutylene succinate. The stretching preferably is performed with a tension of at least 40 MPa. I.e. the staple fibres of polybutylene succinate used in the inventive method are produced by ripping polybutylene succinate filaments after these filaments have been mechanically stretched.

Preferably, the filaments are stretched to an elongation of at least 350%, most preferably of 370%. Further preferably, the stretching is performed with a tension of at least 45 MPa, most preferably of 46 MPa.

The filaments are hence stretched from their original length to at least three times this original length.

It has been observed that the stretching step of the polybutylene succinate filaments further increases the flame resistance of the yarn obtained by the method. It is believed that the mechanical stretching positively influences the melting point of the polybutylene fibres which are formed from the stretched polybutylene filaments.

Preferably, staple fibres of viscose are used and the yarn obtained by the inventive method is a staple yarn.

In an alternatively preferred embodiment, filaments of viscose are used which are arranged to a filament core around which the polybutylene succinate fibres are spun. The yarn obtained with this embodiment of the inventive method therefore is a core yarn.

Preferably, in this embodiment, from 5 to 15 weight-%, more preferably 10 weight-% of fibres of a co-polyester, preferably of a co-polyester which is free of antimony are admixed to the fibres of polybutylene succinate prior to spinning of the yarn. The co-polyester is preferably not admixed when staple fibres of viscose are used to produce a staple yarn.

It was found that the addition of co-polyester allows an increase of the melting temperature of the yarn. Further, addition of co-polyester yields a yarn which is easier to dye.

Preferably, the yarn is spun to a twist per meter of at least 400, preferably of at least 600. Using such a twist results in a further increase of the flame resistance of the yarn obtained by the inventive method.

Preferably, the yarn is subsequently dyed, preferably with a biodegradable reactive dye. This allows to produce a yarn of a specific colour. Use of a biodegradable reactive dye further reduces the environmental impact of the yarn produced by the inventive method.

Other advantageous embodiments and combinations of features come out from the detailed description below and the entirety of the claims.

DETAILED DESCRIPTION OF THE INVENTION

As used throughout the present disclosure, unless specifically stated otherwise, the term "or" encompasses all possible combinations, except where infeasible. For example, the expression "A or B" shall mean A alone, B alone, or A and B together. If it is stated that a component includes "A, B, or C", then, unless specifically stated otherwise or infeasible, the component may include A, or B, or C, or A and B, or A and C, or B and C, or A and B and C. Expressions such as "at least one of" do not necessarily modify an entirety of the following list and do not necessarily modify each member of the list, such that "at least one of "A, B, and C" should be understood as including not only one of A, only one of B, only one of C, or any combination of A, B, and C.

A yarn according to the present invention as well as three yarns belonging to the state of the art were compared in view of their flammability. For this comparative test, a strap of each of the four yarns was hung from a horizontal bar, wherein an identical weight was attached to each strap at its lower end. The vertical length of the strap from the horizontal bar was 28cm. Subsequently, about 2cm at the lower end of each strap were subjected to the flame of a Bunsen burner (Labflame RF of Biotool) for 8 seconds at a temperature of 960° C.

The yarn according to the present invention comprised 45 weight-% of viscose staple fibre 38 mm totally chlorine free and 55 weight-% of organic polybutylene succinate 38 mm. The fibres were wound to a density of 16.7 gram per 1000 m (167 DTEX).

The time until ignition of each of the straps as well as the duration of the subsequent burning of the yarns was measured until complete extinction of each yarn. Finally, the vertical length of each of the yarns was measured after 8 seconds.

The following yarns were used as comparison to the inventive yarn:

| Type | Source | Comment |
|---|---|---|
| Co-Polyester | Inogema GmbH, Eggingen, Germany | Biodegradable yarn, antimony free, multi-filament, petrochemical origin, 167 Dtex |
| Viscose | Lenzing GmbH, Dinslaken, Germany | Biodegradable yarn, staple fibres, 200 Dtex |
| Polyester | Chahan Bursa Polyester, Bursa, Turkey | Polyester treated for low flammability, not biodegradable, multi-filament, 167 Dtex |

The time to ignition of the four filaments was measured twice. The result was as follows (in seconds):

| Inventive yarn | Co-Polyester | Viscose | Polyester |
|---|---|---|---|
| 1.9 | 1.0 | 1.6 | 2.0 |
| 1.5 | 1.1 | 1.4 | 1.8 |

It is apparent that the inventive yarn is equally flame resistant as the treated polyester while being biodegradable. The other biodegradable yarns exhibited a much quicker ignition.

The burning time the yarn for each of the ignition measurements above was measured and was as follows (in seconds):

| Inventive yarn | Co-Polyester | Viscose | Polyester |
|---|---|---|---|
| 1.5 | 4.2 | 5.0 | 2.0 |
| 1.2 | 3.0 | 5.6 | 1.8 |

The burning time until complete extinction of the inventive yarn was found to be even shorter compared to the treated polyester yarn. As is apparent from the table above, the burning time of the inventive yarn is significantly shorter than for any of the yarns with a comparable biodegradability.

The remaining vertical length of each of the yarn straps was measured after 8 seconds (in mm):

| Inventive yarn | Co-Polyester | Viscose | Polyester |
|---|---|---|---|
| 220 | 60 | 42 | 120 |

Again, the inventive yarn yields better results than the polyester which was specifically treated for low flammability. Further, the difference to the other biodegradable yarns tested was found to be very significant.

In summary, the inventive yarn yields comparable good results in view of low flammability as a polyester yarn which has been specifically treated with flame retardant chemicals. In comparison to the latter, the inventive yarn is, however, fully biodegradable. The low flammability of the inventive yarn compared to other biodegradable yarns according to the state of the art was found to be significant.

Since the invention(s) described in detail above are examples of embodiments, they can be modified to a wide extent by the skilled person in the usual manner without departing from the scope of the invention. In particular, the mechanical arrangements and the proportions of the individual elements with respect to each other are merely exemplary. Some preferred embodiments of the apparatus according to the invention have been disclosed above. The invention is not limited to the solutions explained above, but the innovative solutions can be applied in different ways within the limits set out by the claims.

The invention claimed is:

1. A biodegradable yarn with an increased flame resistance comprising from 25 to 55 weight-% of viscose fibres or of viscose filaments, and from 45 to 65 weight-% of polybutylene succinate fibres.

2. The biodegradable yarn according to claim 1, wherein the yarn further comprises from 5 to 15 weight-% of fibres of a co-polyester.

3. The biodegradable yarn according to claim 1, wherein the yarn comprises viscose filaments which act as core of the yarn.

4. The biodegradable yarn according to claim 1, wherein the viscose fibres and/or the polybutylene succinate fibres have an average length of from 25 to 45 mm.

5. The biodegradable yarn according to claim 1, wherein the yarn has a twist per meter of at least 400.

6. The biodegradable yarn according to claim 1, wherein the polybutylene succinate is of organic origin.

7. The biodegradable yarn according to claim 1, wherein the yarn has a linear density of at least 13 gram per 1000 m,.

8. The biodegradable yarn according to claim 1, wherein the yarn further comprises at least one dye.

9. A method for manufacturing a biodegradable yarn with an increased flame resistance according to claim 1, wherein from 25 to 55 weight-% of staple fibres or filaments of viscose and from 45 to 65 weight-% of staple fibres of polybutylene succinate are spun to the yarn.

10. The method according to claim 9, wherein filaments of polybutylene succinate are mechanically stretched to an elongation of at least 300% prior to being ripped to form the staple fibres of polybutylene succinate.

11. The method according to claim 9, wherein staple fibres of viscose are used and the yarn is a staple yarn.

12. The method according to claim 9, wherein filaments of viscose are used which are arranged to a filament core around which the polybutylene succinate fibres are spun, wherein the yarn is a core yarn.

13. The method according to claim 12, wherein from 5 to 15 weight-% of fibres of a co-polyester are admixed to the fibres of polybutylene succinate prior to spinning of the yarn.

14. The method according to claim 9, wherein the yarn is spun to a twist per meter of at least 400.

15. The method according to claim 9, wherein the yarn is subsequently dyed.

16. The biodegradable yarn according to claim 1, wherein the viscose fibres or viscose filaments are chlorine free viscose fibres or viscose filaments.

17. The biodegradable yarn according to claim 1, wherein the co-polyester is a co-polyester free of antimony.

18. The biodegradable yarn according to claim 8, wherein the at least one dye is a biodegradable reactive dye.

19. The method according to claim 10, wherein the filaments of polybutylene succinate are mechanically stretched with a tension of at least 40 MPa.

* * * * *